US010124402B2

(12) United States Patent
Yoon et al.

(10) Patent No.: US 10,124,402 B2
(45) Date of Patent: Nov. 13, 2018

(54) METHODS FOR MANUFACTURING CARBON FIBER REINFORCED ALUMINUM COMPOSITES USING STIR CASTING PROCESS

(71) Applicant: KOREA INSTITUTE OF SCIENCE AND TECHNOLOGY, Seoul (KR)

(72) Inventors: Jin Kook Yoon, Seoul (KR); Kyung Tae Hong, Seoul (KR); Gyeung Ho Kim, Seoul (KR); Young Jun Choi, Seoul (KR); Geun Hun Oh, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 56 days.

(21) Appl. No.: 15/448,788

(22) Filed: Mar. 3, 2017

(65) Prior Publication Data

US 2017/0252798 A1 Sep. 7, 2017

(30) Foreign Application Priority Data

Mar. 4, 2016 (KR) ..... 10-2016-0026153

(51) Int. Cl.
*B22D 11/00* (2006.01)
*B22D 11/117* (2006.01)
(Continued)

(52) U.S. Cl.
CPC ..... *B22D 11/003* (2013.01); *B22D 11/113* (2013.01); *B22D 11/115* (2013.01);
(Continued)

(58) Field of Classification Search
CPC ... B22D 11/003; B22D 11/113; B22D 11/115; B22D 11/117; B22D 7/02
See application file for complete search history.

(56) References Cited

U.S. PATENT DOCUMENTS 3,535,093 A 10/1970 Sara
3,871,834 A 3/1975 Kuniya et al.
(Continued)

OTHER PUBLICATIONS

Ciby, S. et al., "Structure formation during processing short carbon fiber-reinforced aluminum alloy matrix composites," Journal of materials engineering and performance, vol. 2.3, Jun. 1993 (pp. 353-357).

(Continued)

*Primary Examiner* — Kevin E Yoon
*Assistant Examiner* — Steven S Ha
(74) *Attorney, Agent, or Firm* — NSIP Law

(57) ABSTRACT

A method for manufacturing carbon fiber reinforced aluminum composites is provided. Particularly, the method uses a stir casting process during a melting and casting process and reduces a contact angle of carbon against aluminum by inputting carbon fibers while supplying a current to liquid aluminum to induce the carbon fibers to be spontaneously and uniformly distributed in the liquid aluminum and inhibits a formation of an aluminum carbide ($Al_4C_3$) phase on an interface between the aluminum and the carbon fiber, thereby manufacturing carbon fiber reinforced aluminum composites having excellent electrical, thermal and mechanical characteristics.

20 Claims, 7 Drawing Sheets

(51) Int. Cl.

| | |
|---|---|
| ***B22D 11/113*** | (2006.01) |
| ***B22D 11/115*** | (2006.01) |
| ***D01F 9/12*** | (2006.01) |
| ***D06M 11/83*** | (2006.01) |
| ***B22D 19/14*** | (2006.01) |
| ***B22D 21/04*** | (2006.01) |
| ***B22D 27/02*** | (2006.01) |
| ***C22C 47/08*** | (2006.01) |
| *C22C 49/06* | (2006.01) |
| *C22C 49/14* | (2006.01) |

(52) U.S. Cl.

CPC ..... *B22D 11/117* (2013.01); *B22D 19/14* (2013.01); *B22D 21/04* (2013.01); *B22D 27/02* (2013.01); *C22C 47/08* (2013.01); *D01F 9/12* (2013.01); *D06M 11/83* (2013.01); *B22F 2998/00* (2013.01); *B22F 2999/00* (2013.01); *C22C 49/06* (2013.01); *C22C 49/14* (2013.01)

(56) References Cited

U.S. PATENT DOCUMENTS 4,731,298 A 3/1988 Shindo et al.
4,737,382 A 4/1988 Katzman
2009/0176090 A1* 7/2009 So ..... C22C 32/0084 428/367
2014/0170017 A1* 6/2014 Park ..... C22C 21/04 420/548
2014/0202653 A1* 7/2014 Hong ..... C22B 21/06 164/499

OTHER PUBLICATIONS

Naji, H. et al., "The effects of volume percent and aspect ratio of carbon fiber on fracture toughness of reinforced aluminum matrix composites," Materials Science and Engineering: A, vol. 486.1, 2008 (pp. 413-420).
Singh, B. et al., "Processing and properties of copper-coated carbon fibre reinforced aluminum alloy composites," Journal of materials processing technology, vol. 209.4, 2009 (pp. 2104-2110).
Hajjari, E., et al., "Effect of applied pressure and nickel coating on microstructural development in continuous carbon fiber-reinforced aluminum composites fabricated by squeeze casting," Materials and Manufacturing Processes, vol. 26.4, 2011 (pp. 599-603).
Shi, J., et al., "Effect of Mg on Microstructure and Mechanical Properties of Copper-Coated Short Carbon Fiber Reinforced Al Alloy Matrix Composite," Advanced Materials Research, vol. 457, Trans Tech Publications, 2012 (pp. 348-353).
Oh, S., et al., "Fabrication of carbon nanofiber reinforced aluminum alloy nanocomposites by a liquid process," Journal of Alloys and Compounds, vol. 542, 2012 (pp. 111-117).

* cited by examiner

METHODS FOR MANUFACTURING CARBON FIBER REINFORCED ALUMINUM COMPOSITES USING STIR CASTING PROCESS

CROSS-REFERENCE TO RELATED APPLICATION

This application claims under 35 U.S.C. § 119(a) the benefit of priority to Korean Patent Application No. 10-2016-0026153 filed on Mar. 4, 2016, the entire contents of which are incorporated herein by reference.

BACKGROUND (a) Technical Field

The present disclosure relates to a method of manufacturing carbon fiber reinforced aluminum composites. More particularly, the present disclosure relates to a method that includes a stir casting process during melting and casting processes and reduces a contact angle of carbon against aluminum by inputting carbon fibers while supplying a current to liquid aluminum not only to make the carbon fibers spontaneously and uniformly distributed in the liquid aluminum but to inhibit a formation of an aluminum carbide ($Al_4C_3$) phase on an interface of the aluminum and the carbon fiber, thereby manufacturing carbon fiber reinforced aluminum composites having excellent electrical, thermal and mechanical characteristics.

(b) Background Art

Carbon fiber reinforced aluminum composites (hereinafter, "aluminum-carbon fiber composite") mean a composite material in which carbon fibers are uniformly distributed in aluminum matrix metal as a reinforcing agent. The aluminum-carbon fiber composite has advantages of light weight, high intensity, high stiffness, excellent electric conductivity, excellent thermal conductivity, a small thermal expansion coefficient, excellent wear resistance, and an excellent high temperature property The aluminum-carbon fiber composite has been in the spotlight of industrial fields including structural materials for transportation equipments such as automobiles and aircrafts, machinery industry materials, civil engineering and construction materials, energy field materials, leisure and sports materials, electric and electronic materials, and the like.

Thermal, electrical, and mechanical properties of the aluminum-carbon fiber composite may depend on a technology of uniformly distributing the carbon reinforcing agent in the aluminum matrix metal, a technology of enhancing interfacial bonding strength between aluminum and the carbon fiber, and a technology of preventing an internal defect of the composite. Further, the properties of the aluminum-carbon fiber composite may be influenced by the type, size, shape, and volume fraction of added carbon fibers and a manufacturing process, etc.

A manufacturing process of the aluminum-carbon fiber composite may be generally divided into a solid-phase manufacturing process that use the solid aluminum and a liquid-phase manufacturing process that use the liquid aluminum.

The solid manufacturing process that uses the solid aluminum without melting the aluminum matrix metal may representatively include a powder metallurgy process, a diffusion bonding process, a spray forming process, and the like. The solid-phase manufacturing process can produce a composite whose mechanical properties are superior but the manufacturing cost is high and mass production is difficult, as compared with the liquid-phase manufacturing process.

The liquid-phase manufacturing process using the melted aluminum may representatively include stir casting, compocasting, squeeze casting, infiltration, and the like, and of which the stir casting is the simplest process and the most appropriate for mass production due to the property of being formed in a near-net shape. However, due to the nature of the liquid-phase manufacturing process, a density difference between the aluminum and the carbon fiber is large; carbon fiber are easily tangled because of low wettability by liquid aluminum; a large amount of pores and impurities may be generated during a stirring process; and a brittle $Al_4C_3$ phase is easily formed on the interface between the aluminum and the carbon fiber. And as a result, the stir casting is seldom used in manufacturing the aluminum-carbon fiber composite.

As a result, various studies have been conducted in order to improve the wettability of the carbon fiber by the liquid aluminum and inhibit the formation of the aluminum carbide ($Al_4C_3$) phase on the interface between the aluminum and the carbon fiber.

A first method is to coat the surface of carbon fiber with metal (Ni, Cu, Ag, Ti, Ta, W, etc.), carbide (SiC, TiC, Pyrolytic carbon, etc.), oxide ($Al_2O_3$, $TiO_2$, $ZrO_2$, $SiO_2$, etc.), and boride ($TiB_2$, etc.). However, this additional coating process before manufacturing the composite leads to non-economic feasibility. Furthermore, it is difficult to evenly coat the surface of carbon fibers.

A second method is to input an additive (Mg, Ti, Si, Zr, Cr, Ca, $K_2ZrF_6$, $K_2TiF_6$, etc.) into a aluminum melt. However, the mechanical properties of the matrix may be changed by the additive.

Therefore, in order to commercialize the aluminum-carbon fiber composite, it is urgent to develop an economical manufacturing process suitable for the mass production, standardize the characteristics of the composite, and ensure reliability.

Accordingly, while the present inventors have studied a mass production method for commercialization of the aluminum-carbon fiber composite, they have applied the stir casting which is the simplest process among the other manufacturing technologies for aluminum-carbon fiber composite and is available in near-net shape forming, and as a result, they have completed the present invention by developing a new liquid-phase manufacturing process capable of solving the problems pointed out in the general stir casting.

The above information disclosed in this Background section is only for enhancement of understanding of the background of the invention and therefore it may contain information that does not form the prior art that is already known in this country to a person of ordinary skill in the art.

PRIOR ART DOCUMENT

Patent Document (Patent Document 1) U.S. Pat. No. 3,535,093 "Aluminum composite containing carbon fibers coated with silver"

(Patent Document 2) U.S. Pat. No. 3,871,834 "Carbon-fiber-reinforced aluminum composite material"

(Patent Document 3) U.S. Pat. No. 4,737,382 "Carbide coatings for fabrication of carbon-fiber-reinforced metal matrix composites"

(Patent Document 4) U.S. Pat. No. 4,731,298 "Carbon fiber-reinforced light metal composites"

Non-Patent Document (Non-patent Document 1) S. Ciby, B. C. Pai, K. G. Satyanarayana, V. K. Vaidyan, P. K. Rphatgi, "Structure formation during processing short carbon fiber-reinforced aluminum alloy matrix composites", Journal of Materials Engineering and Performance, 2 (1993) 353-357.

(Non-patent Document 2) H. Naji, S. M. Zebarjad, S. A. Sajjadi, "The effects of volume percent and aspect ratio of carbon fiber on fracture toughness of reinforced aluminum matrix composites" Materials Science Engineering, 486A (2008) 413-420.

(Non-patent Document 3) B. Bhav Singh, M. Balasubramanian, "Processing and properties of copper-coated carbon fibre reinforced aluminum alloy composites", Journal of Materials Processing Technology, 209 (2009) 2104-2110.

(Non-patent Document 4) E. Hajjari, M. Divandari, H. Arabi, "Effect of applied pressure and nickel coating on microstructural development in continuous carbon fiber-reinforced aluminum composites fabricated by squeeze casting" Materials and manufacturing processes, 26 (2011) 559-603.

(Non-patent Document 5) J. C. Shi, Y. H. Li, G. C. Yao, P. F. Yan, H. Liu, "Effect of Mg on microstructure and mechanical properties of copper-coated short carbon fiber reinforced Al alloy matrix composite", Advanced Materials Research, 457-458 (2012) 348-353.

(Non-patent Document 6) S. I. Oh, J. Y. Han, Y. C. Kim, J. I. Yoon, G. H. Kim, J. H. Lee, Y. M. Sung, J. H. Han, "Fabrication of carbon nanofiber reinforced aluminum alloy composites by a liquid process", Journal of Alloys and Compounds, 542 (2012) 111-117.

SUMMARY OF THE DISCLOSURE

The present invention has been made in an effort to solve the above-described problems associated with the related art and to provide a method for manufacturing an aluminum-carbon fiber composite, in which carbon fibers are uniformly distributed in aluminum matrix metal and a formation of an aluminum-carbide ($Al_4C_3$) phase, which may degrade a mechanical properties, on an interface of aluminum and the carbon fiber is inhibited.

In one aspect, the present invention provides a method for manufacturing an aluminum-carbon fiber composite, the method including: (a) a pre-treatment step of a carbon fiber; (b) a melting step of aluminum or aluminum alloys by heating to above temperature of each melting point; (c) a step of stirring the; (d) a step of supplying a current to the stirred aluminum melt; (e) a step of inputting the carbon fiber into the aluminum melt in which current supply and stirring are simultaneously performed; and (f) a step of casting the aluminum melt into which the carbon fiber is input.

In a preferred embodiment, the method may further include (g) a step of processing the cast aluminum-carbon fiber composite through plastic deformation by forging, rolling, or extrusion.

In another preferred embodiment, the pre-treatment of the carbon fiber in step (a) may be performed by a dry method consisting of a process of heat-treating the carbon fiber at a temperature of 250 to 600° C. in a vacuum atmosphere, an inert gas atmosphere, or the atmosphere for 0.5 to 5 hours.

In still another preferred embodiment, the pre-treatment of the carbon fiber in step (a) may be performed by a wet method consisting of an ultrasonic washing process of the carbon fiber by using a solvent selected from acetone and alcohol.

In yet another preferred embodiment, the pre-treatment of the carbon fiber in step (a) may be progressively performed by the dry method consisting of the heat-treating process and the wet method consisting of the ultrasonic washing process using the solvent.

In still yet another preferred embodiment, in step (b), aluminum or an aluminum alloy may be hot and melted at a temperature more than or equal to that of melting point in a melting furnace selected from the group consisting of an induction furnace, an electric resistance furnace, a gas furnace, a reverberatory furnace, and an arc furnace.

In a further preferred embodiment, the stirring of step (c) may be performed by a mechanical stirring method, an ultrasonic stirring method, a centrifugal stirring method, an electromagnetic stirring method, or two or more mixed complex stirring methods selected from the stirring methods.

In another further preferred embodiment, in step (d), the current may be supplied as DC current, AC current, or as a combination of the DC current and the AC current.

In still another further preferred embodiment, in step (d), the preset current may be supplied periodically or consecutively by using a power supply device or a welding machine.

In yet another further preferred embodiment, in step (e), an input quantity of the carbon fiber may be in a content range of 1 to 30 wt % based on a total weight of the composite composed of the aluminum and the carbon fiber.

In still yet another preferred embodiment, the step (a), (b), (c), (d), (e), or (f) may be performed in the vacuum atmosphere, the inert gas atmosphere, or the atmosphere.

In a still further preferred embodiment, when the composite is manufactured by performing the step (a), (b), (c), (d), (e), or (f) in the vacuum atmosphere or inert gas atmosphere, an Al—C—O reaction layer may be formed on the interface between the aluminum and the carbon fiber.

In another still further preferred embodiment, when the composite is manufactured by performing the step (a), (b), (c), (d), (e), or (f) in the atmosphere, an amorphous reaction layer and a mixed reaction layer of a crystalline reaction layer and the amorphous reaction layer may be generated on the interface between the aluminum and the carbon fiber.

In yet another still further preferred embodiment, the method may further include (e-1) a step of degassing the aluminum melt into which the carbon fiber is input when the steps (a), (b), (c), (d), and (e) are performed in the inert gas atmosphere or the atmosphere.

In still yet another still further preferred embodiment, the step of degassing (e-1) may be performed by using at least one method selected from the group consisting of a vacuum degassing method; a bubbling method using active gas or inert gas; an ultrasonic vibration method; and a degassing material using method.

In a yet still further preferred embodiment, as the active gas used in the step of degassing (e-1), chlorine gas may be used.

In another yet still further preferred embodiment, as the inert gas used in the step of degassing (e-1), at least one selected from the group consisting of argon, nitrogen, and helium may be used.

In still another yet still further preferred embodiment, as the degassing material in the step of degassing (e-1), at least one chloride selected from the group consisting of hexachloroethane ($C_2Cl_6$), zinc chloride ($ZnCl_2$), magnesium chloride ($MgCl_2$) and zirconium chloride ($ZrCl_4$) may be used.

In a yet another still further preferred embodiment, as the degassing material used in the step of degassing (e-1), at least one fluoride selected from the group consisting of potassium fluoride (KF) and potassium zirconium fluoride ($K_2ZrF_6$) may be used.

In another yet another still further preferred embodiment, as the degassing material used in the step of degassing (e-1), chlorine and fluorine may be used.

In still another yet another still further preferred embodiment, in the manufactured aluminum-carbon fiber composite, the carbon fibers may be uniformly distributed in the aluminum matrix metal.

In yet another yet another still further preferred embodiment, in the manufactured aluminum-carbon fiber composite, an aluminum carbide ($Al_4C_3$) phase may not be formed on the interface between the aluminum and the carbon fiber.

In still yet another yet another still further preferred embodiment, in the manufactured aluminum-carbon fiber composite, when the manufactured aluminum-carbon fiber composite is remelted while the current is not supplied, the carbon fiber which exists in the composite may not float onto the surface of the melt.

In a still yet another further preferred embodiment, in the aluminum-carbon fiber composite in which the remelted composite is cast, the carbon fibers may be uniformly distributed in the aluminum matrix metal and the aluminum carbide ($Al_4C_3$) phase may not be formed on the interface between the aluminum and the carbon fiber.

In the method for manufacturing an aluminum-carbon fiber composite according to the present invention, the stir casting, which is the simplest among the other manufacturing technologies, is used, and as a result a processing cost is low as compared with the compocasting or squeeze casting which is included in the liquid-phase manufacturing process. As a result, the method for manufacturing an aluminum-carbon fiber composite according to the present invention has an effect of expanding a utilization range of the aluminum-carbon fiber composite because automation is easy and the composite can be continuously produced accordingly.

By the method for manufacturing an aluminum-carbon fiber composite according to the present invention, wettability of carbon is improved within melted aluminum and thus carbon fibers can be spontaneously distributed to acquire a composite in which the carbon fibers are uniformly distributed in aluminum matrix metal.

By the method for manufacturing an aluminum-carbon fiber composite according to the present invention, since an aluminum carbide ($Al_4C_3$) phase is not formed on an interface between the aluminum and the carbon fiber, the mechanical properties of the composite are improved.

When the aluminum-carbon fiber composite manufactured by the manufacturing method according to the present invention is remelted under a condition that no electric current is supplied, the carbon fibers which exist in the composite do not float to the surface of a melt and the carbon fibers are uniformly distributed in the aluminum matrix metal even after resolidification. As a result, the aluminum-carbon fiber composite manufactured by the manufacturing method according to the present invention can be recycled.

It is easy to process the aluminum-carbon fiber composite manufactured by the manufacturing method according to the present invention as desired through additional plastic deformation by forging, rolling, or extrusion.

BRIEF DESCRIPTION OF THE DRAWINGS

The above and other features of the present invention will now be described in detail with reference to certain exemplary embodiments thereof illustrated in the accompanying drawings which are given hereinbelow by way of illustration only, and thus are not limitative of the present invention, and wherein.

Figure 1:
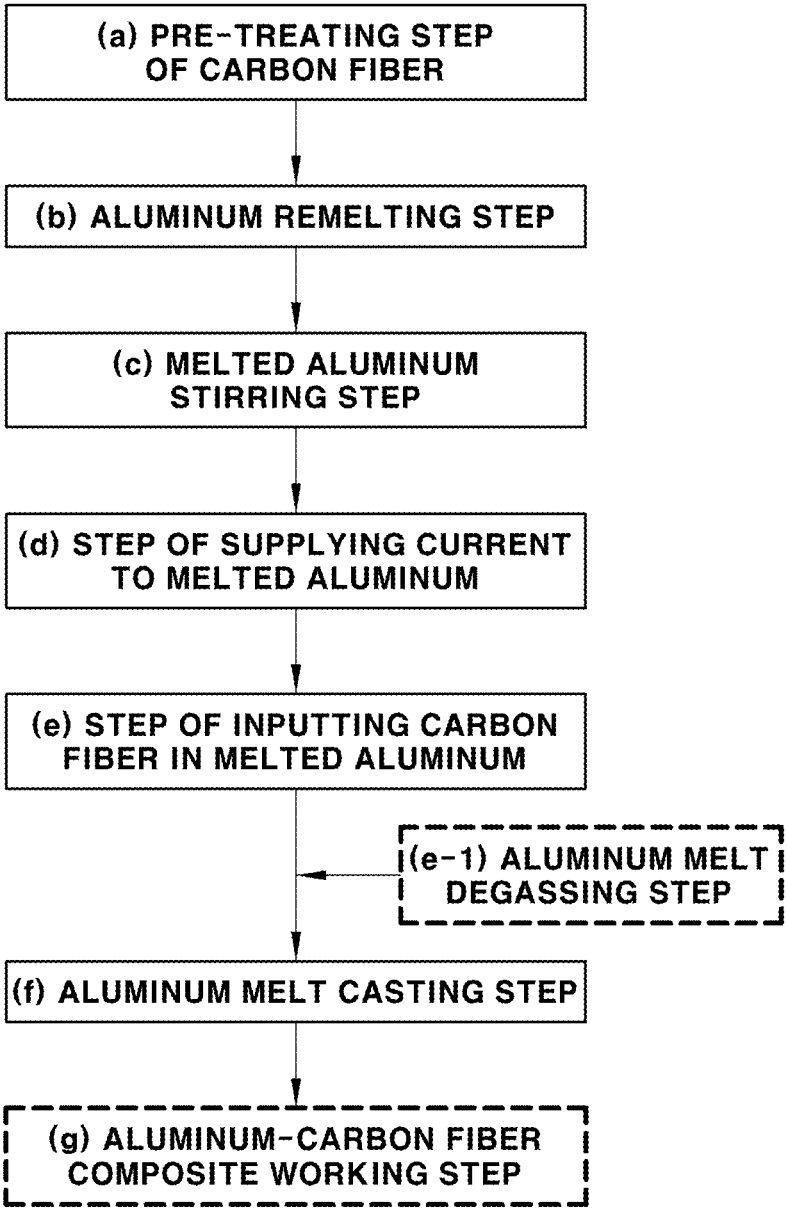
FIG. 1 is a process diagram illustrating a method for manufacturing an aluminum-carbon fiber composite according to the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The advantages and features of the present invention, and methods of accomplishing an object will become obvious with reference to embodiments to be described below in detail. However, the present invention is not limited to the embodiments set forth below, and may be embodied in various different forms. The present embodiments are just for rendering the description of the present invention complete and are set forth to provide a complete understanding of the scope of the invention to a person with ordinary skill in the technical field to which the present invention pertains, and the present invention will only be defined by the scope of the claims.

Hereinafter, a method for manufacturing an aluminum-carbon fiber composite using a stir casting process according to the present invention will be described in detail with reference to the accompanying drawings.

FIG. 1 is a process diagram illustrating a method for manufacturing an aluminum-carbon fiber composite according to the present invention.

As illustrated in FIG. 1, the method for manufacturing an aluminum-carbon fiber composite according to the present invention includes: (a) a step of pre-treating a carbon fiber, (b) a melting step of aluminum or aluminum alloys by heating to above temperature of each melting point, (c) a step of stirring a aluminum melt, (d) a step of supplying a current to the stirred aluminum melt, (e) a step of inputting the carbon fiber into the aluminum melt in which current supply and stirring are simultaneously performed, and (f) casting the aluminum melt into which the carbon fiber is input.

When the steps (a), (b), (c), (d), and (e) are performed in an inert gas atmosphere or in the atmosphere, the method may further include (e-1) a step of degassing the aluminum melt into which the carbon fiber is input.

The method may further include (g) a step of processing the cast aluminum-carbon fiber composite through plastic deformation by forging, rolling, or extrusion.

Hereinafter, the respective steps of the method for manufacturing an aluminum-carbon fiber composite according to the present invention will be described in more detail.

(a) Step of Pre-Treating Carbon Fiber

In the present invention, a current is applied to a mixture of the melted aluminum and the carbon fiber to reduce a contact angle of the carbon fiber against liquid aluminum, and thus the carbon fibers are spontaneously and uniformly distributed in the aluminum melt. Therefore, a surface characteristic of the carbon fiber used as a reinforcing agent may be very important for the present invention.

In particular, a short carbon fiber used in the present invention is mostly manufactured through a sizing step with epoxy. When the epoxy-treated carbon fiber is input into the aluminum melt, gas is generated to cause many pores to be formed in the aluminum-carbon fiber composite and in addition, interface tension of the carbon increases to prevent uniform distribution of the carbon fibers in the aluminum melt. Therefore, before the carbon fiber is input into the aluminum melt, a pre-treatment step for removing impurities such as the epoxy is preferably performed.

The process of pre-treating the carbon fiber according to the present invention may be largely divided into a dry method and a wet method. The dry method is performed by a process of heat-treating the carbon fiber at a high temperature. In detail, the dry method may be performed by a process of heat-treating the carbon fiber at a temperature of 250 to 600° C. in a vacuum atmosphere, the inert gas atmosphere, or the atmosphere for 0.5 to 5 hours. The dry method may be effective in removing moisture, the gas, and other impurities adsorbed in the carbon fiber. In addition, the wet method is performed by an ultrasonic washing process using a solvent selected from acetone and alcohol. The solvent applied to the wet method may include, in detail, the acetone, methanol, ethanol, propanol, isopropanol, butanol, hexanol, and the like. The wet method may be effective in removing ultrafine carbon powder, products after heat-treatment, and other impurities attached to the surface of the carbon fiber. In the process of pre-treating the carbon fiber according to the present invention, the dry method and the wet method are preferably used together.

The carbon fiber used in examples of the present invention as a T700 short carbon fiber product of Toray in Japan, is a 12K fiber bundle having a diameter of 7 μm and a length of 6 mm. The short carbon fiber product is subjected to sizing with 1% epoxy. Thermogravimetric analysis (TGA) is performed in order to determine an appropriate heat-treatment temperature for pre-treating the short carbon fiber product through the high-temperature heat-treatment.

Figure 2:
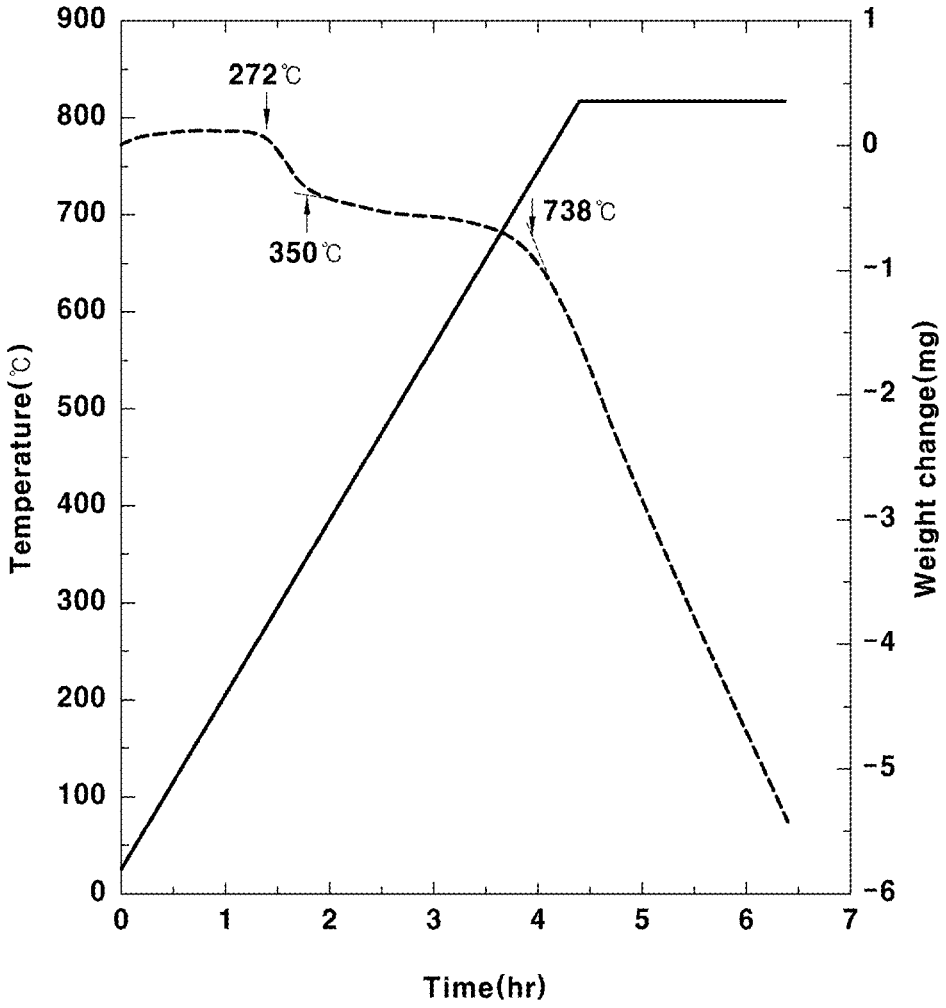
FIG. 2 is a graph illustrating the measurement of change in weight of a short carbon fiber as a function of time during heating the carbon fiber up to 800° C. in the atmosphere by using a thermogravimetric analyzer.

FIG. 2 illustrates a thermogravimetric analysis result of a short carbon fiber by using Thermo Gravimetric Analyzer (TGA-51) of Shimadzu in Japan. The weight change of the carbon fiber is measured while heating up to 800° C. at a heating rate of 3° C./min in the atmosphere. According to FIG. 2, a reduction of the weight starts by vaporization of the epoxy from 272° C. and there was almost no change in weight from 350° C. or higher and the weight is abruptly reduced by oxidation of the carbon fiber from 738° C. or higher. Therefore, when the carbon fiber is pre-treated by the dry method, the heat treatment process at a temperature of 250 to 600° C. in the vacuum atmosphere, the inert gas atmosphere, or the atmosphere for 0.5 to 5 hours may be preferably applied.

More preferably, in the step of pre-treating the carbon fiber, after the dry method is performed in the vacuum atmosphere, the inert gas atmosphere, or the atmosphere at 250 to 600° C. for 0.5 to 5 hours, the wet method is performed, which performs washing using an ultrasonic cleaner with the solvent selected from the acetone and the alcohol. Further, preferably, the carbon fiber pre-treated by the wet method is dried in a dryer at 100 to 150° C. for 0.5 to 5 hours and thereafter, is input into the aluminum melt.

(b) Aluminum Melting Step

In the present invention, the melting and casting processes of the aluminum are performed by the stir casting.

All of the processes for manufacturing the aluminum-carbon fiber composite by using the stir casting of the present invention may be performed under the condition of the vacuum atmosphere, the inert gas atmosphere, or the atmosphere and preferably, all of the processes are performed in the inert gas atmosphere or vacuum atmosphere. When all of the processes for manufacturing the aluminum-carbon fiber composite according to the present invention are performed in the atmospheric condition, the processes under the atmospheric condition are the most economical method which is suitable for the mass production of the composite. However, when all of the processes are performed under the atmospheric condition, there is a concern that the characteristics of the aluminum-carbon fiber composite will be reduced by oxygen or moisture which exists on the surface of the carbon fiber or between the pores, or by oxygen or moisture in the atmosphere, which is absorbed into the melt during stirring of the aluminum melt, or by impurities on the surface of the melt. Therefore, when the processes are performed under the atmospheric condition, it is preferable to sufficiently carry out (e-1) the degassing step before casting the aluminum melt.

In the aluminum melting step of the present invention, a reaction chamber manufactured to maintain the condition of the vacuum atmosphere, inert gas atmosphere, or atmosphere is used in order to melt pure aluminum or the aluminum alloys. In addition, the reaction chamber is equipped with a supply device for supplying the carbon fiber used as the reinforcing agent, and the pure aluminum, the aluminum alloys, or a mixture thereof used as matrix metal is charged in a crucible.

A melting furnace for melting the pure aluminum or aluminum alloys may be selected from the group consisting of, in detail, an induction furnace, an electric resistance furnace, a gas furnace, a reverberatory furnace, and an arc furnace.

Before performing the melting step, it is preferable that the oxygen which exists in the reaction chamber and a carbon supply device is first exhausted. The exhaustion may adopt an inert gas exhaustion method, a vacuum exhaustion method, or a mixture method of the inert gas exhaustion method and the vacuum exhaustion method.

The inert gas in the present invention as gas which does not influence melting and casting of the aluminum may adopt, for example, one gas or mixed gas of two or more gases selected from the group consisting of argon, nitrogen, and helium.

(c) Stirring Step of Melted Aluminum

When melting the aluminum is completed, the melt is sufficiently stirred. The stirring may be performed by any one method selected among a mechanical stirring method, an ultrasonic stirring method, a centrifugal stirring method, an electromagnetic stirring method, and the like or a complex stirring method in which two or more stirring methods are mixed. Further, the melt is preferably stirred at a rotational speed to form a vortex so that the carbon fiber having lower density than the melted aluminum does not float onto the surface of the melt but flows into the melt.

In the example of the present invention, an example of stirring the aluminum melt by the mechanical stirring method using an impeller is presented in detail, but the stirring method of the present invention is not limited thereto.

(d) Current Supply Step

In the present invention, the wettability of the carbon by liquid aluminum is improved by inputting the carbon fiber while the current is supplied to the melted aluminum to make the carbon fibers spontaneously distributed into aluminum melt.

In order to supply the current to the melted aluminum, a method that charges two electrodes into the aluminum melt, a method that charges one electrode into the melt and uses the crucible as the other electrode, a method that charges one electrode into the melt and uses the impeller used for the mechanical stirring of the melt as the other electrode, or a method that uses the impeller used for the mechanical stirring of the melt as one electrode and uses the crucible as the other electrode may be used. In this case, a distance between both electrodes preferably maintains an interval of approximately 1 to 30 cm.

A density of the current supplied into the aluminum melt may be defined as a current amount supplied per a surface area of the carbon fiber input into the melt. An appropriate current density range may be variously changed depending on the type, the shape, the surface area, and the like of the carbon fiber used as the reinforcing agent. Nevertheless, if the current supplied to the melt is particularly limited, the current may be preferably in the range of 10 to 1,000 A per square-meter surface area of the carbon fiber. When the current supplied to the melt is too high or the distance between both electrodes is too short, there is a high possibility that the size of the carbon fiber added as the reinforcing agent will be changed due to the occurrence of carbon dissolution. On the contrary, when the current supplied to the melt is too low or the distance between both electrodes is too long, the current density in the aluminum melt is low and the wettability of the carbon by the liquid aluminum may not be thus enhanced, and as a result, it may be difficult to spontaneously distribute the carbon fiber in the melt.

As a material of the electrode, a carbon electrode may be representatively used. In addition to the carbon electrode, all materials which show low reactivity with the melted aluminum and have a low resistance value may be adopted as the electrode materials. As the current supplied to the melt, DC current, AC current, or mixed current of the DC current and the AC current may be supplied. Further, in the case of supplying the current, a power supply device, a welding machine, and the like may be installed and preset current may be supplied periodically at a predetermined interval or consecutively.

(e) Input Step of Carbon Fiber into Aluminum Melt

The carbon fiber used as the reinforcing agent is input into the aluminum melt. The input of the carbon fiber is processed in condition in which the current is supplied to the aluminum melt and the aluminum melt is stirred so as to form the vortex. When the carbon fiber is input under such a condition, the contact angle of the carbon by liquid aluminum decreases and a nonwetting characteristic of the carbon fiber is changed to a wetting characteristic to induce the carbon fibers to be spontaneously distributed in the melted aluminum.

In general, since the contact angle of the carbon by liquid aluminum at 700° C. is a high angle in the range of 140 to 150°, the wettability of the carbon by liquid aluminum is poor. Further, since the carbon fiber has the lower density than the aluminum, the carbon fiber tends to float onto the surface of the melt. Therefore, it is not easy to input the carbon fiber into the aluminum melt by the simple stir casting, and as a result, it is difficult to uniformly distribute the carbon fibers in the aluminum matrix metal.

However, as proposed by the present invention, when the current is supplied to the melted aluminum, the contact angle of the carbon by liquid aluminum decreases and the carbon fiber does not thus float onto the surface of the melt and the carbon fiber may flow into the melt, thereby uniformly distributing the carbon fibers in the aluminum matrix metal. Further, in the case of an electric field effect applied to a mixture of the melted aluminum and the carbon fiber, the carbon fiber does not float onto the surface of the melt in spite of removing an electric field. From such a result, creativity of the present invention may be verified as compared with a technology for manufacturing the aluminum-carbon fiber composite by using a liquid-phase manufacturing process released in the related art.

In the present invention, the effect of improving the wettability of the carbon by liquid aluminum by supplying the current is clearly different from a generally known 'electrowetting' phenomenon. That is, electrowetting is a phenomenon in which electric charges are accumulated on the surface of an insulator to influence the wettability when voltage is applied to an electrode and a conductive fluid from the outside when a conductive fluid and a nonconductive fluid are in contact with each other on an electrode coated with the insulator. The electrowetting phenomenon is restored to an original state when the voltage is removed.

However, when the voltage is applied to the mixture of the liquid aluminum and the carbon fiber having excellent conductivity from the outside as described in the present invention, electrons rapidly pass through the mixture, and as a result, it is difficult that the electric charges are accumulated in the interface between the aluminum melt and the carbon fiber. That is, the electrowetting phenomenon is not shown between conductive materials such as the melted aluminum and the carbon fiber. Further, the present invention is clearly different from the electrowetting phenomenon in that the carbon fiber does not float onto the surface of the melt in spite of removing the current applied to the mixture of the melted aluminum and the carbon fiber.

In the present invention, the carbon fiber as the reinforcing agent is input into the aluminum melt. In the case of an input quantity of the carbon fibers, the carbon fibers may be input in the range of 1 to 30 wt % and preferably input in the range of 1 to 20 wt % based on a total weight of the composite composed of the aluminum and the carbon fiber. When the input quantity of the carbon fibers is less than 1 wt % based on the total weight of the composite, an improvement effect of the strength and the stiffness acquired by adding the carbon fiber reinforcing agent may be insufficient. On the contrary, when the input quantity of the carbon fibers is more than 30 wt % based on the total weight of the composite, the viscosity of the melt increases and stirring and casting may be thus difficult and the strength and the stiffness may be improved, but there is a high possibility that the aluminum-carbon fiber composite will be degraded as elongation is reduced.

(e-1) Degassing Processing Step

In general, there is a high possibility that many pores exist in a casting materials manufactured by the stir casting. Fraction, sizes, or distribution of the pores which exist in the casting materials may cause the mechanical properties and corrosion resistance of the casting material to be degraded. Accordingly, in order to manufacture the aluminum-carbon composite having the excellent mechanical properties and corrosion resistance, it is important to minimize the quantity of the pores which exist in the composite.

Therefore, in the present invention, the degassing processing step may be performed as necessary before the casting step of the melt. In particular, when the steps (a), (b), (c), (d), and (e) are performed in the inert gas atmosphere or in the atmosphere, degassing the aluminum melt may be preferable after inputting the carbon fiber is completed. On the contrary, when the steps (a), (b), (c), (d), and (e) are performed in the vacuum atmosphere, the degassing processing step of the melt may be omitted.

In the degassing processing step according to the present invention, at least one method may be used, which is selected from the group consisting of a vacuum degassing method; a bubbling method using active gas or inert gas; an ultrasonic vibration method; and a degassing material using method. Each of the degassing processing methods is a method used for removing gas in the art and the present invention is not particularly limited to the degassing processing method. Further, the degassing processing method may be variously transformed and applied by considering porosity formed in the manufactured composite.

Even in addition to the degassing processing method performed before the casting step, the quantity of the pores which exist in the cast aluminum-carbon fiber composite may be minimized by applying the squeeze casting or a postprocessing method that compresses the pore, such as compression, drawing, or rolling after casting.

The vacuum degassing method is a degassing processing method through a process that depressurizes the pressure of the reaction chamber to 0.1 torr or less. In detail, while the melt is maintained for approximately 10 minutes to 2 hours with being stirred at a constant speed in the state where the pressure of the reaction chamber is depressurized to 0.1 torr or less using a rotary vacuum pump, the vacuum degassing processing may be performed.

Gas applied to the gas bubbling method may include the inert gas, the active gas, or mixed gas of the inert gas and the active gas. The inert gas may include at least one selected from the group consisting of argon, nitrogen, and helium. The active gas may include chlorine gas, and the like.

A degassing material applied to the degassing material using method may include metal chloride, metal fluoride, or a mixture of the metal chloride and the metal fluoride. In detail, the metal chloride may include at least one selected from the group consisting of hexachloroethane ($C_2Cl_6$), zinc chloride ($ZnCl_2$), magnesium chloride ($MgCl_2$) and zirconium chloride ($ZrCl_4$). The metal fluoride may include at least one selected from the group consisting of potassium fluoride (KF) and potassium zirconium fluoride ($K_2ZrF_6$).

(f) Casting Step of Melt

The aluminum melt into which the carbon fiber as the reinforcing agent is input is tapped and thereafter, cooled to manufacture the aluminum-carbon fiber composite. The tapping may adopt a method that puts the aluminum melt into which the carbon fiber is input in a mold or a continuous casting method suitable for producing a composite plate. The continuous casting method may be, in detail, performed by a method that forms an opening on one side of a container storing the aluminum melt into which the carbon fiber is input and thereafter, tapping the melt through the opening. The continuous casting method has also an advantage that the composite is mass-produced. The cooling may be performed by various methods including natural cooling, forced cooling, and the like. The tapping and cooling methods of the present invention are not particularly limited.

(g) Working Step of Composite

In the present invention, a step of plastically deforming and processing the cast aluminum-carbon fiber composite may be additionally performed. The working process may be performed by the processing method which is conventionally used in the art, such as forging, rolling, or extrusion.

Even though a processing material is manufactured by performing additional plastic deformation of the aluminum-carbon fiber composite by as forging, rolling, or extrusion at reduction ratio of approximately 95% at room temperature as described in Example 3 given below, the interface between the aluminum and the carbon fiber is not separated. That is, the aluminum-carbon fiber composite manufactured according to the present invention is excellent in room-temperature workability.

In the case of the aluminum-carbon fiber composite reported up to now, the aluminum carbide ($Al_4C_3$) phase is formed, which is vulnerable to the aluminum-carbon fiber interface or in the case of coating the surface of the carbon fiber with Ni, Cu, and the like, vulnerable intermetallic compound layers are formed, which include $Ni_3Al$, $Ni_2Al_3$, $CuAl_2$, and the like, thereby degrading the mechanical properties of the composite.

As a result of observing the casting structure of the aluminum-carbon fiber composite manufactured through the process proposed by the present invention with the scanning electron microscope, it can be seen that the carbon fibers are uniformly distributed in the aluminum matrix metal.

The interface between the aluminum and the carbon fiber is verified by using the transmission electron microscope. In the case of the aluminum-carbon fiber composite manufactured in the vacuum atmosphere or inert gas atmosphere, an Al—C—O reaction layer is formed on the interface between the aluminum and the carbon fiber. Further, in the case of the aluminum-carbon fiber composite manufactured in the atmosphere, two reaction layers of an amorphous reaction layer and a mixed reaction layer of a crystalline reaction layer and the amorphous reaction layer are formed on the interface between the aluminum and the carbon fiber.

In the aluminum-carbon fiber composite manufactured according to the present invention, the aluminum carbide ($Al_4C_3$) phase is not formed on the interface between the aluminum and the carbon fiber regardless of the condition of the vacuum atmosphere, the inert gas atmosphere, or the atmosphere.

The aluminum-carbon fiber composite manufactured according to the present invention may maintain almost the same physical and mechanical properties as a new product even though the aluminum-carbon fiber composite manufactured according to the present invention is recycled. In detail, even though the aluminum-carbon fiber composite is remelted under a condition in which the current is not supplied, the carbon fiber does not float onto the surface of the melt. Further, when the melt in which the aluminum-carbon fiber composite is remelted is tapped and solidified and cast again, the carbon fibers are still uniformly distributed in the aluminum matrix structure similarly to the new product in the recast aluminum-carbon fiber composite and there is no large change even in an interface state of the aluminum and the carbon fiber.

Hereinafter, main contents and features of the present invention will be more clearly described through examples and the present invention is not limited to the following examples and various modifications and applications can be made within claims.

EXAMPLES

Example 1. Manufacturing Aluminum-5 wt % Carbon Fiber Composite in Vacuum Atmosphere A graphite crucible and a reinforcing agent supply device were fixed to an Inconel 601 chamber manufactured to maintain the vacuum atmosphere. Pure aluminum (99.99%) of 4.75 kg was charged into the graphite crucible, vacuum-exhausted up to $5\times10^{-3}$ torr by using the rotary vacuum pump and thereafter, high-purity argon (99.9999%) is supplied at a flow speed of 2 L/min to remove the oxygen which exists in the chamber and the reinforcing agent supply device. The vacuum exhaustion process was performed three times or more.

The aluminum was melted by heating the aluminum up to 720° C. by using the electric resistance furnace while supplying argon gas to the chamber and the reinforcing agent supply device at the flow speed of 2 L/min. When the temperature of the aluminum melt was stabilized, a graphite impeller and a graphite electrode were charged into the melt. The melt was stirred so that the vortex is formed on the surface of the melt by using an electric motor after maintaining the pressure of the chamber to 0.1 torr by using the rotary vacuum pump.

When the vortex was formed on the surface of the melt, a carbon fiber of 250 g was directly input around the vortex from the reinforcing agent supply device at a constant speed while periodically supplying DC current of 300 A through the graphite electrode charged into the melt by using a power supply device. In this case, an input speed of the carbon fiber was approximately 10 g/min. Two graphite electrodes are arrayed in the melt at an interval of 9 cm so that the current flows in the mixture of the melted aluminum and the carbon fiber.

In Example 1, as the carbon fiber, a T700 short carbon fiber product (a 12K fiber bundle having a diameter of 7 μm and a length of 6 mm) of Toray in Japan was used. Epoxy and other impurities which exist on the surface of the short carbon fiber product was removed by performing pre-treatment of the carbon fiber which is charged into the reinforcing agent supply device. The pre-treatment was performed by heat-treating the carbon fiber at a temperature of 500° C. in the vacuum atmosphere of $5\times10^{-3}$ torr for 3 hours and thereafter, performing an ultrasonic washing process of the carbon fiber with the acetone and the alcohol.

When inputting the carbon fiber into the aluminum melt was completed, the current supply was interrupted and the pressure in the chamber increased to an atmospheric pressure by using the argon gas and thereafter, the aluminum melt was tapped to an iron mold preheated at 200° C. in the atmosphere and solidified at the room temperature to manufacture the 'aluminum-5 wt % carbon fiber composite'. After the inputting the carbon fiber ended, the carbon fiber did not float onto the surface of the melt in spite of interrupting the current supply.

Figure 3:
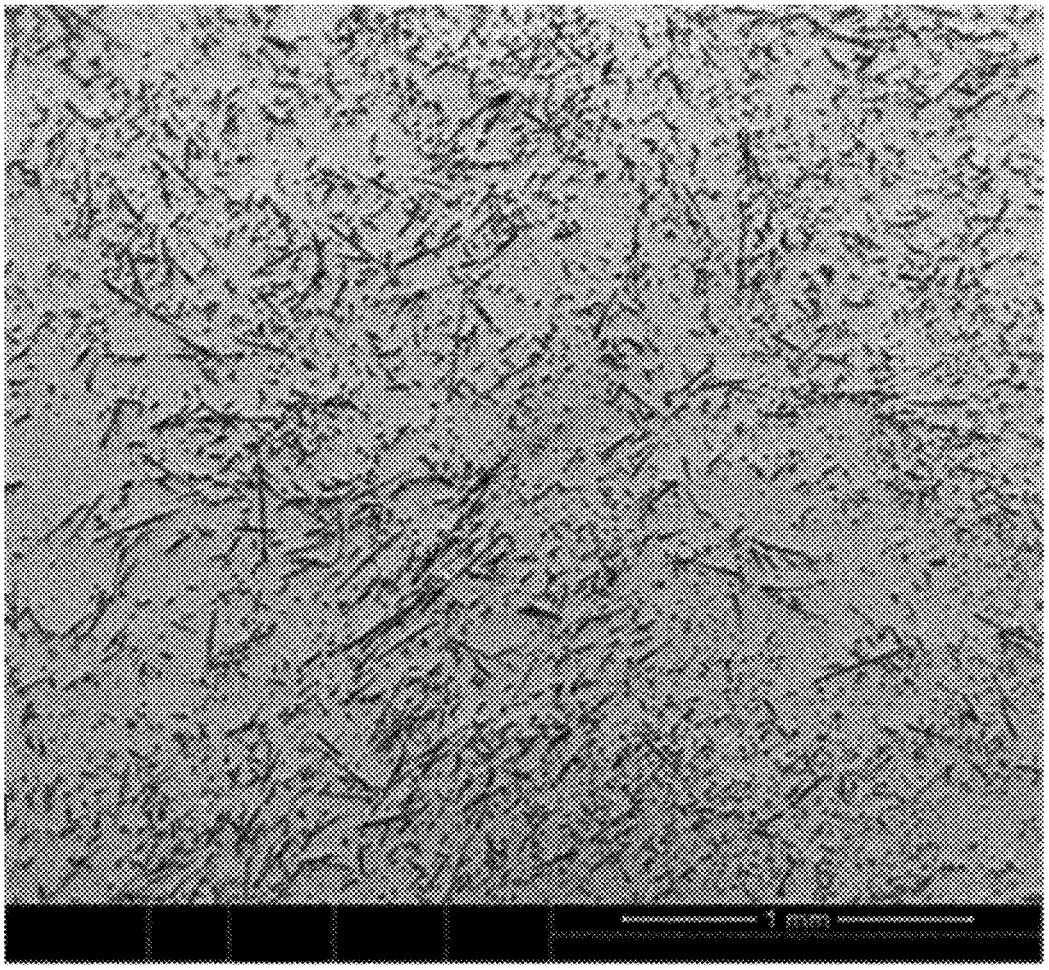
FIG. 3 is a photograph of a casting structure acquired by observing an aluminum-5 wt % carbon fiber composite manufactured in Example 1 by using a scanning electron microscope.

FIG. 3 illustrates a result acquired by enlarging hundred-fold and observing a casting structure of the aluminum-5 wt % carbon fiber composite manufactured in Example 1 by using the scanning electron microscope. According to FIG. 3, it can be seen that the carbon fibers are uniformly distributed in the aluminum matrix metal.

Figure 4:
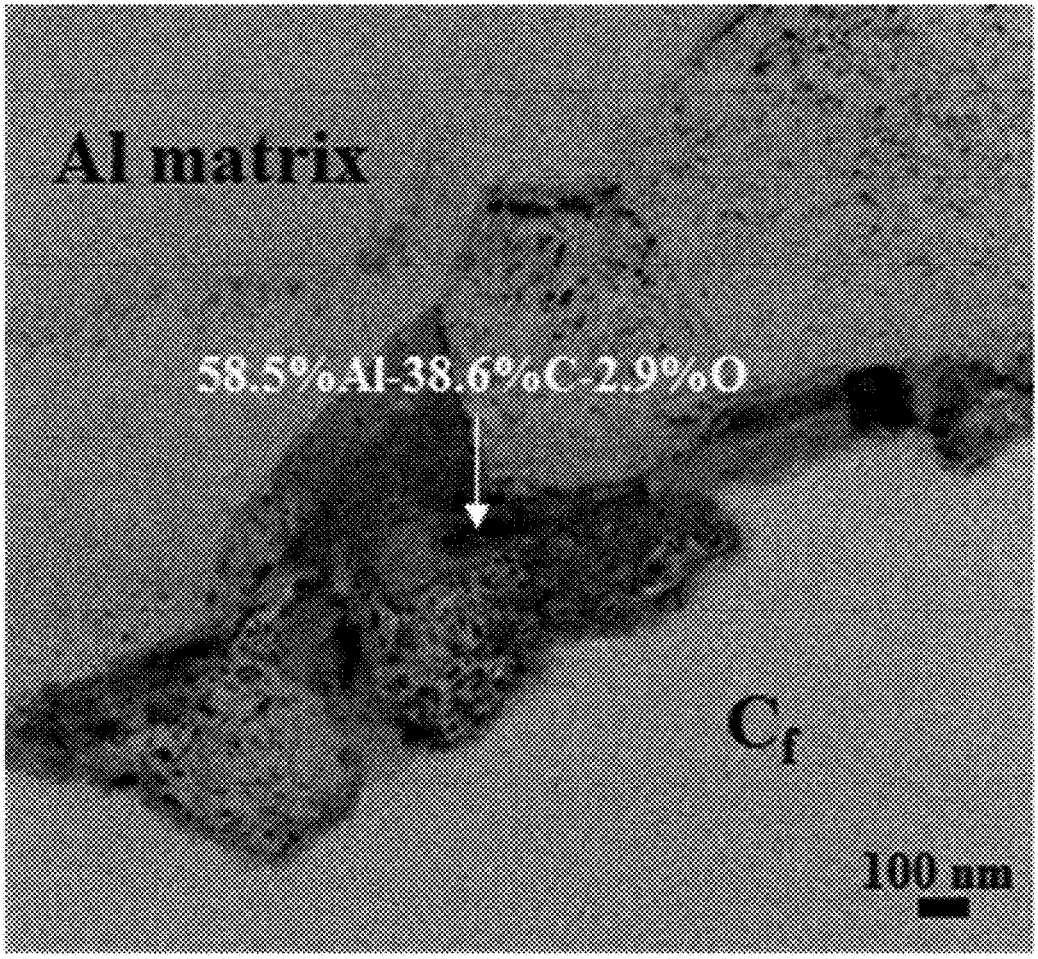
FIG. 4 is a photograph of a structure acquired by observing an interface between aluminum and the carbon fiber in the casting structure of the aluminum-5 wt % carbon fiber composite manufactured in Example 1 by using a transmission electron microscope.

FIG. 4 illustrates a result acquired by observing an interface between aluminum and a carbon fiber in the casting structure of the aluminum-5 wt % carbon fiber composite manufactured in Example 1 by using a transmission electron microscope. A brittle $Al_4C_3$ phase was not formed. Further, as a result of element analysis by an energy dispersive spectroscopy (EDS) analysis method, it was seen that a reaction layer having a composition of 58.5% Al-38.6% C-2.9% O (atomic ratio) was formed on the interface between the aluminum and the carbon fiber.

Figure 5:
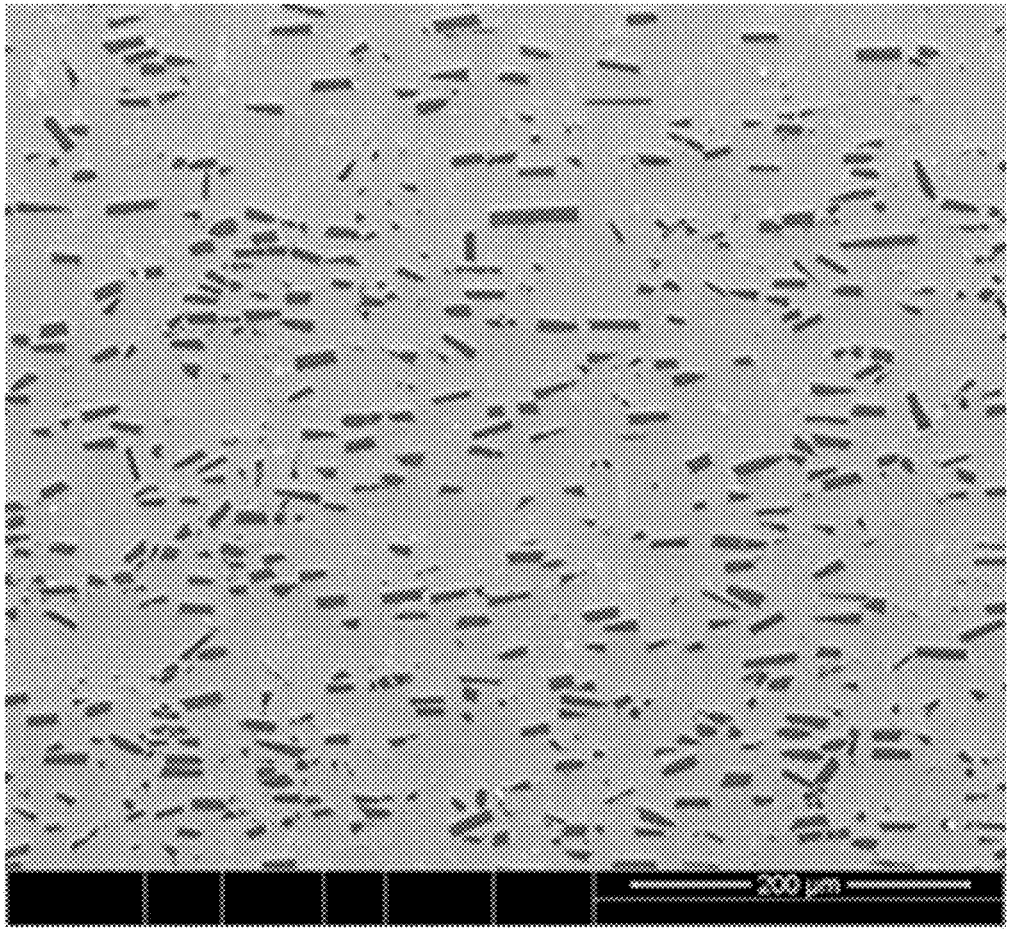
FIG. 5 is a photograph of a microstructure of a composite acquired by observing an aluminum-5 wt % carbon fiber composite after cold-rolled aluminum-5 wt % carbon fiber composite manufactured in Example 1 to a reduction ratio of 95% by scanning electron microscope.

FIG. 5 illustrates a micro structure of a composite acquired by cold-rolling the aluminum-5 wt % carbon fiber composite manufactured in Example 1 at a rolling reduction ratio 95% and thereafter, observing the cold-rolled aluminum-5 wt % carbon fiber composite by using a scanning transfer microscope. According to FIG. 5, it can be seen that carbon fibers which exist in an aluminum matrix structure are arrayed in a rolling direction and are comparatively uniformly fractured with a length of 30 to 50 μm.

An increase in the strength of the aluminum-carbon fiber composite depends on transfer of stress from the aluminum matrix structure to the carbon fiber. When a load is applied to the composite in which the vulnerable $Al_4C_3$ phase is formed on the aluminum-carbon fiber interface, the brittle $Al_4C_3$ phase cracks before the carbon fiber is fractured and a crack is thus generated and the crack is transferred along the interface between the carbon fiber and the aluminum before the composite is fractured, and as a result, since it is impossible to transfer the stress from the matrix structure to the carbon fiber, the composite is fractured.

Figure 6:
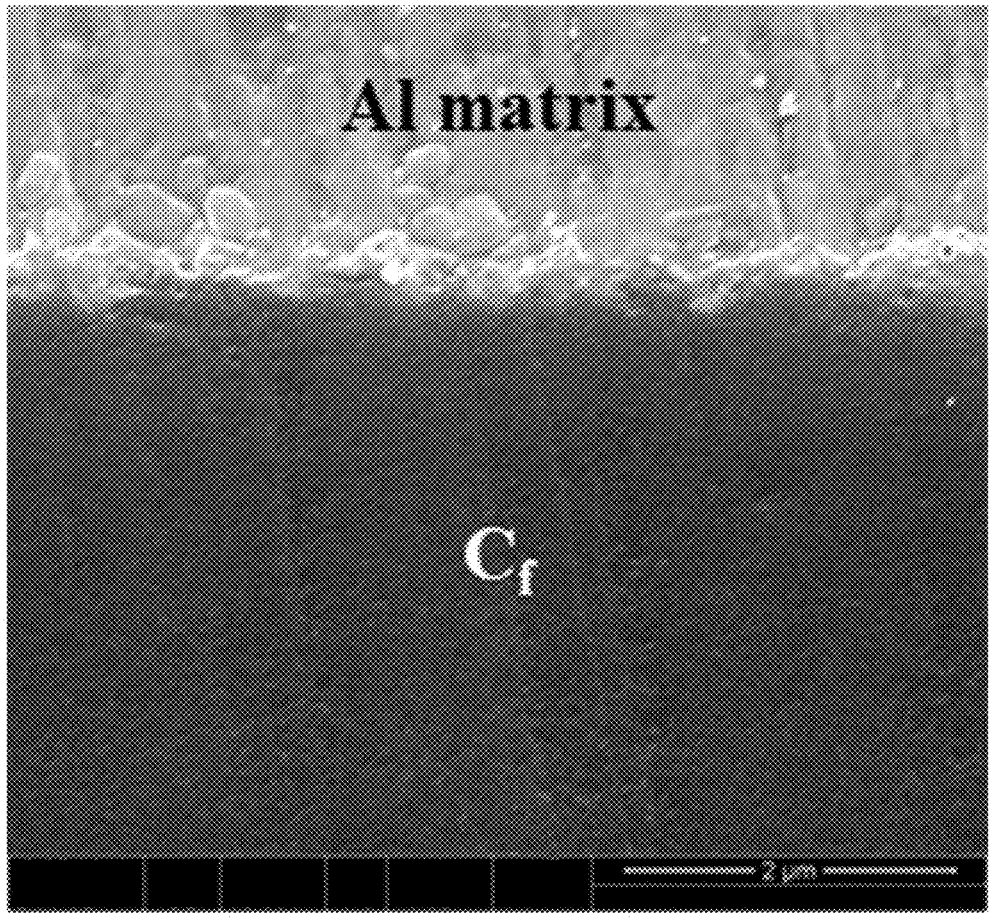
FIG. 6 is a photograph of a microstructure acquired by observing the interface between the aluminum and the carbon fiber in FIG. 5 by the scanning electron microscope.

FIG. 6 is a result acquired by observing the interface between the aluminum and the carbon fiber in FIG. 5 by a high-magnification scanning electron microscope. According to FIG. 6, it can be seen that even though the composite is cold-rolled at a rolling reduction ratio 95% the interface of the aluminum and the carbon fiber is not separated but well bonded.

Example 2. Manufacturing Aluminum-5 wt % Carbon Fiber Composite in Atmosphere The graphite crucible and the reinforcing agent supply device were fixed to a 310 stainless chamber. Pure aluminum (99.99%) of 4.75 kg was charged into the graphite crucible and heated up to 720° C. in the atmosphere by using the electric resistance furnace to melt the aluminum. When the temperature of the melt was stabilized, the graphite impeller and the graphite electrode were charged into the melt and the melt was stirred so that the vortex is formed on the surface of the melt by using the electric motor.

When the vortex is formed on the surface of the melt, the carbon fiber of 250 g was directly input around the vortex in the same method as Example 1.

When inputting the carbon fiber into the aluminum melt was completed, the current supply was interrupted. In addition, the argon was degassed for 30 minutes while supplying the argon into the melt at a flow rate of 3 L/min through the center of an impeller rod which rotates. The degassing-processed aluminum melt was tapped to the iron mold preheated at 200° C. in the atmosphere and solidified at the room temperature to manufacture the 'aluminum-5 wt % carbon fiber composite'.

Figure 7:
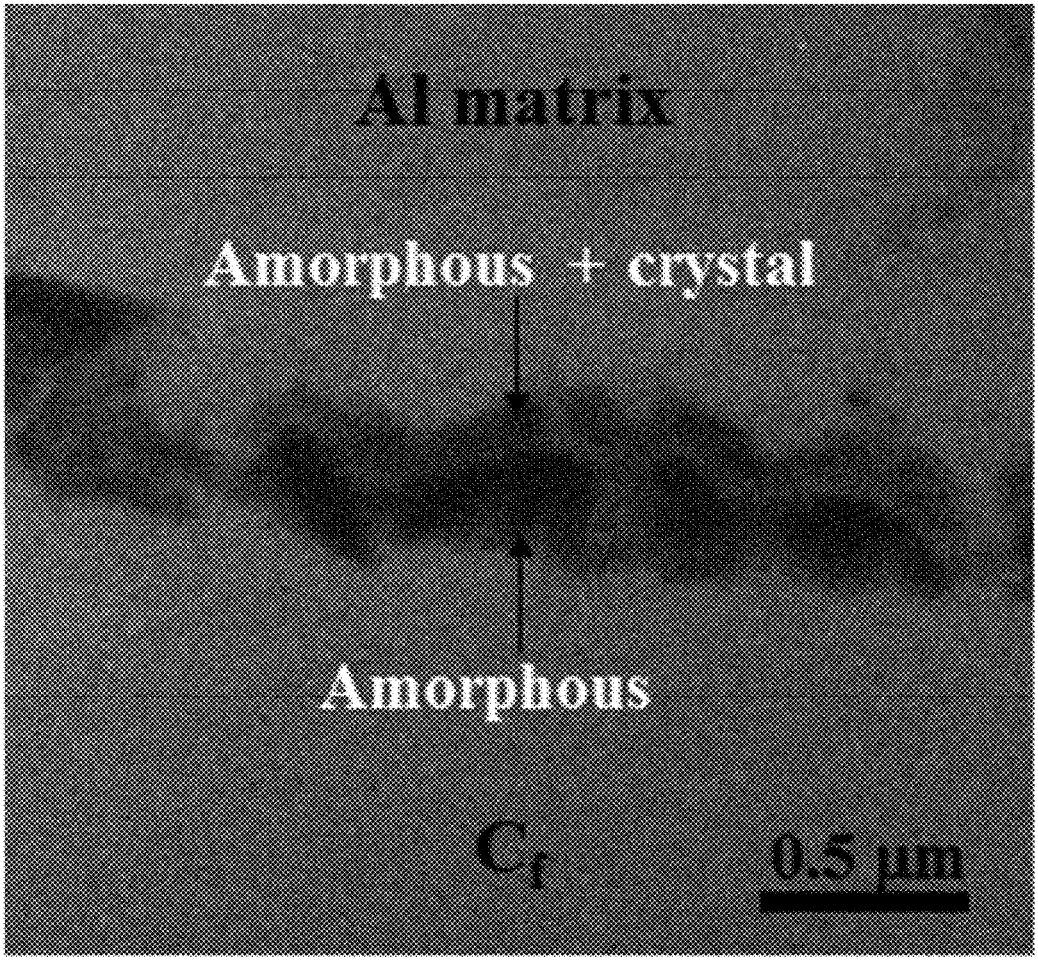
FIG. 7 is a photograph of a structure acquired by observing an interface between aluminum and the carbon fiber in a casting structure of the aluminum-5 wt % carbon fiber composite manufactured in Example 2 by using the transmission electron microscope.

FIG. 7 illustrates a result acquired by observing the interface of aluminum and the carbon fiber in the casting structure of the aluminum-5 wt % carbon fiber composite manufactured in Example 2 by using the transmission electron microscope. It can be seen that the brittle $Al_4C_3$ phase is not formed. Further, it was verified that two reaction layers of the amorphous reaction layer and the mixed reaction layer of the crystalline reaction layer and the amorphous reaction layer having an Al—C—O composition were formed.

Example 3. Recycling Aluminum-Carbon Fiber Composite

The graphite crucible was fixed to the 310 stainless chamber and the aluminum-5 wt % carbon fiber composite of 5 kg, which is manufactured in Example 1, was charged into the crucible. The composite was melted by heating the composite up to 720° C. in the atmosphere by using the electric resistance furnace and maintained for 5 hours. The composite was remelted under a condition in which the current is not supplied during the remelting process. The remelted composite was tapped to the iron mold preheated at 200° C. and solidified at the room temperature to manufacture the 'aluminum-5 wt % carbon fiber composite'.

The remelted composite melt was maintained for 5 hours under the condition in which the current is not supplied, but the carbon fiber did not float onto the surface of the melt. Further, as a result of observing the casting structure of the aluminum-5 wt % carbon fiber composite which is remelted and manufactured, by using the scanning electron microscope, the carbon fibers were uniformly distributed in the aluminum matrix metal and the recycled composite of the present invention is not largely different from the new product. As a result, it can be seen that the aluminum-carbon fiber composite provided by the present invention may be recycled.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A method for manufacturing a carbon fiber reinforced aluminum composite, the method comprising:

(a) a step of pre-treating carbon fibers;

(b) a step of melting of aluminum or aluminum alloys by heating at a temperature more than or equal to that of each melting point;

(c) a step of stirring the aluminum melt;

(d) a step of supplying a current to the stirred aluminum melt;

(e) a step of inputting the carbon fibers into the aluminum melt in which current supply and stirring are simultaneously performed; and (f) a step of casting the aluminum melt into which the carbon fibers are input, wherein the pre-treating of step (a) is performed by at least one of a dry method and a wet method, wherein the dry method is configured by a process of heat-treating the carbon fibers at a temperature of 250° C. to 600° C. in a vacuum atmosphere, in an inert gas atmosphere, or in an ambient atmosphere for 0.5 to 5 hours, and wherein the wet method is configured by an ultrasonic washing process of the carbon fibers by using a solvent selected from acetone and alcohol.

2. The method of claim 1, further comprising:

(g) a step of working the cast aluminum-carbon fiber composite through plastic deformation by forging, rolling, or extrusion.

3. The method of claim 1, wherein the stirring of step (c) is performed by a mechanical stirring method, an ultrasonic stirring method, a centrifugal stirring method, an electromagnetic stirring method, or a complex stirring method, in which two or more stirring methods selected from the above stirring methods are mixed.

4. The method of claim 1, wherein in step (d), the current is supplied as DC current, AC current, or by mixing the DC current and the AC current.

5. The method of claim 1, wherein in step (d), the current is supplied periodically or consecutively by using a power supply device or a welding machine.

6. The method of claim 1, wherein in step (e), the carbon fibers are input in a content range of 1 to 30 wt % based on a total weight of the composite composed of the aluminum and the carbon fibers.

7. The method of claim 1, wherein the step (b), (c), (d), (e), or (f) is performed in the vacuum atmosphere or another vacuum atmosphere, in the inert gas atmosphere or another inert gas atmosphere, or in the ambient atmosphere or another ambient atmosphere.

8. The method of claim 7, wherein in the case of the composite manufactured by performing the steps in the vacuum atmosphere or in the inert gas atmosphere, an Al—C—O reaction layer is formed on an interface between the aluminum and the carbon fibers.

9. The method of claim 7, wherein in the case of the composite manufactured by performing the steps in the atmosphere, an amorphous reaction layer and a mixed reaction layer of a crystalline reaction layer and the amorphous reaction layer are formed on an interface between the aluminum and the carbon fibers.

10. The method of claim 7, further comprising:

(e-1) a step of degassing the aluminum melt into which the carbon fibers are input when the steps (a), (b), (c), (d), and (e) are performed in the inert gas atmosphere or the atmosphere.

11. The method of claim 10, wherein in the degassing step (e-1), the degassing is performed by using at least one method selected from the group consisting of a vacuum degassing method; a bubbling method using active gas or inert gas; an ultrasonic vibration method; and a degassing material using method.

12. The method of claim 11, wherein as the active gas, chlorine gas is used.

13. The method of claim 11, wherein as the inert gas, at least one selected from the group consisting of argon, nitrogen, and helium is used.

14. The method of claim 11, wherein, as the degassing material at least one chloride selected from the group consisting of hexachloroethane ($C_2Cl_6$), zinc chloride ($ZnCl_2$), magnesium chloride ($MgCl_2$) and zirconium chloride ($ZrCl_4$) is used.

15. The method of claim 11, wherein as the degassing material at least one fluoride selected from the group consisting of potassium fluoride (KF) and potassium zirconium fluoride ($K_2ZrF_6$) is used.

16. The method of claim 11, wherein as the degassing material, at least one chloride selected from the group consisting of hexachloroethane ($C_2Cl_6$), zinc chloride ($ZnCl_2$), magnesium chloride ($MgCl_2$) and zirconium chloride ($ZrCl_4$) and at least one fluoride selected from the group consisting of potassium fluoride (KF) and potassium zirconium fluoride ($K_2ZrF_6$) are mixed to be used.

17. The method of claim 1, wherein in the manufactured aluminum-carbon fiber composite, the carbon fibers are uniformly distributed in an aluminum matrix metal.

18. The method of claim 1, wherein in the manufactured aluminum-carbon fiber composite, an interface between the aluminum and the carbon fibers is substantially free from aluminum carbide ($Al_4C_3$) phase.

19. A method for manufacturing a carbon fiber reinforced aluminum composite, the method comprising:

(a) a step of pre-treating carbon fibers;

(b) a step of melting of aluminum or aluminum alloys by heating at a temperature more than or equal to that of each melting point;

(c) a step of stirring the aluminum melt;

(d) a step of supplying a current to the stirred aluminum melt;

(e) a step of inputting the carbon fibers into the aluminum melt in which current supply and stirring are simultaneously performed; and (f) a step of casting the aluminum melt into which the carbon fibers are input, wherein when the aluminum-carbon fiber composite is remelted while the current is not supplied, the carbon fiber does not float onto a surface of the melt.

20. The method of claim 19, wherein in the aluminum-carbon fiber composite in which the remelted composite melt is cast, the carbon fibers are uniformly distributed in an aluminum matrix metal and an aluminum carbide ($Al_4C_3$) phase is not formed on an interface between the aluminum and the carbon fiber.

* * * * *